US005127179A

United States Patent [19]

Marsh

[11] Patent Number: 5,127,179

[45] Date of Patent: Jul. 7, 1992

[54] MUZZLE LOADING FIREARM LOADING KIT

[76] Inventor: Theodore J. Marsh, R.D. #1, Box 562, Dubois, Pa. 15801

[21] Appl. No.: 797,377

[22] Filed: Nov. 25, 1991

[51] Int. Cl.[5] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 4,373,285 | 2/1983 | Grout et al. | 42/90 |
| 4,407,086 | 10/1983 | Hasselmann | 42/90 |
| 4,466,209 | 8/1984 | Strickland et al. | 42/90 |
| 4,473,965 | 10/1984 | Erikson | 42/90 |
| 4,536,983 | 8/1985 | Fry | 42/90 |
| 4,813,169 | 3/1989 | Calliebe | 42/90 |
| 4,862,623 | 9/1989 | Delap et al. | 42/90 |
| 5,016,380 | 5/1991 | Jones | 42/90 |

*Primary Examiner*—Charles T. Jordan

*Attorney, Agent, or Firm*—Leon Gilden

[57] ABSTRACT

A plurality of extension rods securable relative to one another in a coaxially aligned relationship are mounted within a "U" shaped framework arranged for selective securement relative to one another, with the "U" shaped framework mounting a plurality of cleaning tips thereon for ease of usage. A modification of the invention includes an optical viewing device in association with the kit to enhance ease of viewing of various components within an associated firearm.

6 Claims, 5 Drawing Sheets

MUZZLE LOADING FIREARM LOADING KIT

BACKGROUND OF THE INVENTION

1. Field of the Invention

The field of invention relates to muzzle loading apparatus, and more particularly pertains to a new and improved muzzle loading firearm loading kit wherein the same permits ease of loading and maintenance of a muzzle loading firearm.

2. Description of the Prior Art

The use of muzzle loading firearms for sport and competition is readily recognized in the prior art. To accommodate such usage of firearms, the prior art has recognized a need to provide for the maintenance of such firearms and the relative loading and cleaning of muzzle loading equipment that requires continuous cleaning to maintain accuracy thereof. The prior art has recognized this need and has set forth various components for loading of firearms of a muzzle loading type exemplified in U.S. Pat. No. 4,466,209 to Strickland, et al. wherein a muzzle loading kit includes a chamber for gun powder at one end and a projectile at the other end for ease of loading.

U.S. Pat. No. 4,536,983 to Fry sets forth a further example of a muzzle loading kit to direct a bullet within a muzzle loading upper terminal end.

The U.S. Pat. Nos. 4,373,285 to Grout, et al.; 4,473,965 to Eriksen; and 4,862,623 to Delap, et al. are further examples of muzzle loading apparatus.

Accordingly, it may be appreciated that there continues to be a need for a new and improved muzzle loading firearm loading kit as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of firearm loading apparatus now present in the prior art, the present invention provides a muzzle loading firearm loading kit wherein the same is arranged to ease the loading and cleaning of various components in the use of a muzzle loading firearm. As such, the general purpose of the present invention, which will be described subsequently in greater detail, is to provide a new and improved muzzle loading firearm loading kit which has all the advantages of the prior art firearm loading apparatus and none of the disadvantages.

To attain this, the present invention provides a plurality of extension rods securable relative to one another in a coaxially aligned relationship mounted within a "U" shaped framework arranged for selective securement relative to one another, with the "U" shaped framework mounting a plurality of cleaning tips thereon for ease of usage. A modification of the invention includes an optical viewing device in association with the kit to enhance ease of viewing of various components within an associated firearm.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved muzzle loading firearm loading kit which has all the advantages of the prior art firearm loading apparatus and none of the disadvantages.

It is another object of the present invention to provide a new and improved muzzle loading firearm loading kit which may be easily and efficiently manufactured and marketed.

It is a further object of the present invention to provide a new and improved muzzle loading firearm loading kit which is of a durable and reliable construction.

An even further object of the present invention is to provide a new and improved muzzle loading firearm loading kit which is susceptible of a low cost of manufacture with regard to both materials and labor, and which accordingly is then susceptible of low prices of sale to the consuming public, thereby making such muzzle loading firearm loading kits economically available to the buying public.

Still yet another object of the present invention is to provide a new and improved muzzle loading firearm loading kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
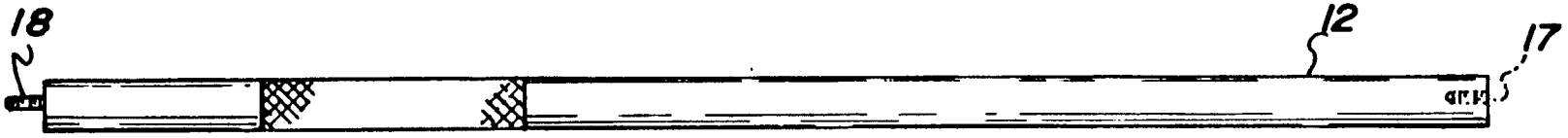
FIG. 1 is an orthographic side view of a rod extension utilized by the invention.
Figure 2:
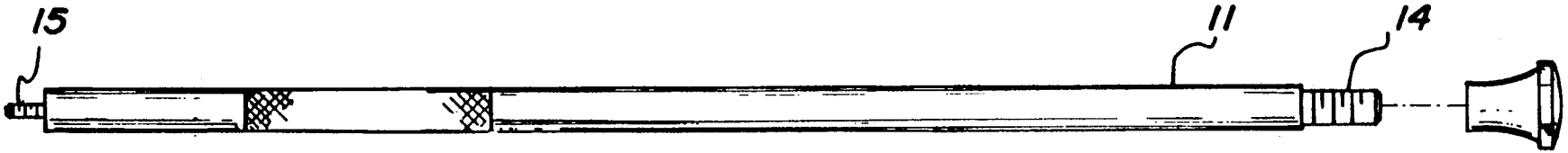
FIG. 2 is an orthographic view of a primary rod structure utilized by the invention.
Figure 3:
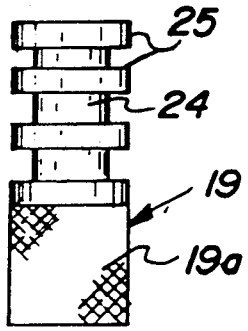
FIGS. 3, 4, 5, 6, and 7 are orthographic views, taken in elevation, of the various tip members utilized by the kit structure of the invention.
Figure 4:
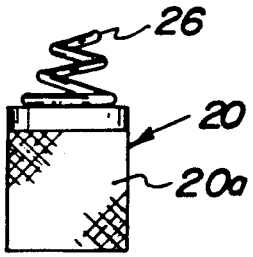
Figure 5:
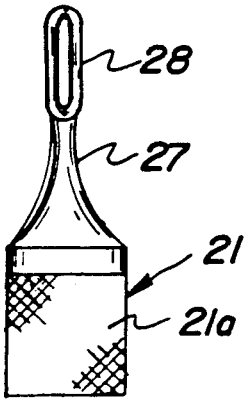
Figure 6:
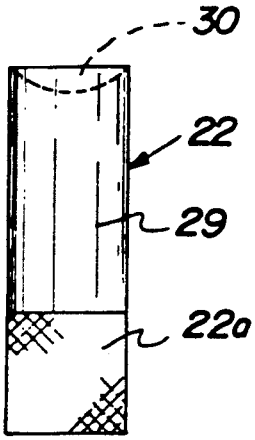
Figure 7:
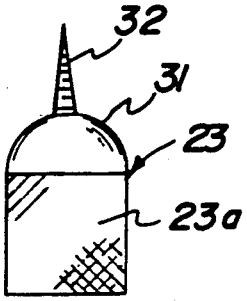
Figure 9:
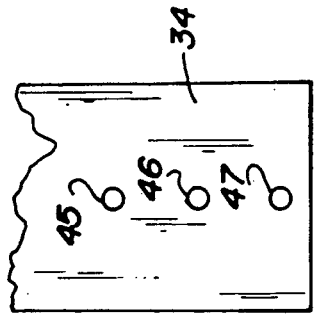
FIG. 9 is an orthographic view, taken along the lines 9—9 of FIG. 8 in the direction indicated by the arrows.

With reference now to the drawings, and in particular to FIGS. 1 to 14 thereof, a new and improved muzzle loading firearm loading kit embodying the principles and concepts of the present invention and generally designated by the reference numerals 10 and 10*a* will be described.

Figure 14:
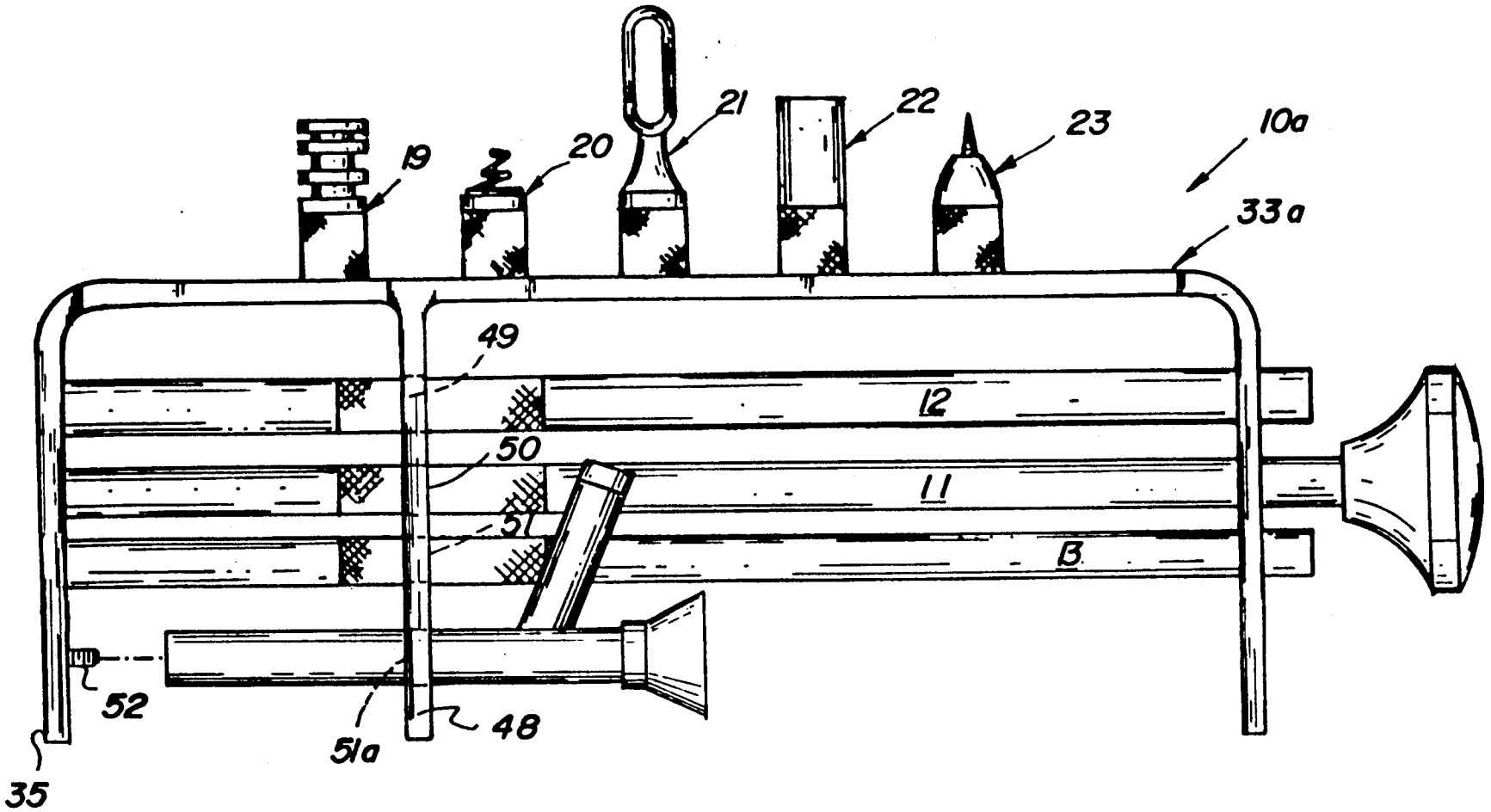
FIG. 14 is an orthographic side view of a modified kit structure utilized by the invention.

Mores specifically, the muzzle loading firearm loading kit 10 of the instant invention essentially comprises a primary rod 11 of generally cylindrical configuration selectively securable to at least a first extension 12 and as required a second extension 13 (see FIG. 14). The primary rod includes a first threaded boss 14 at a first distal end arranged for securement to a handle boss 16, with a second threaded boss 15 selectively securable to an extension first end bore 17, with an extension rod second end threaded rod 18 arranged for securement to an associated tip member of a plurality of tip members, such as illustrated in the FIGS. 3-7, or to the second extension rod 13 of a like configuration to the first extension rod 12. The tip members include a first tip member 19, a second tip member 20, a third tip member 21, a fourth tip member 22, and a fifth tip member 23 including a respective first, second, third, fourth, and fifth cylindrical tip shank 19*a*, 20*a*, 21*a*, 22*a*, and 23*a*, each including a threaded coaxially aligned bore extending into the shank from a bottom surface thereof to coaxially align each respective tip relative to an associated primary rod or extension rod as required, as the tip members may be secured to the primary rod threaded boss 15 or an extension rod threaded boss rod 18. The first tip member includes a cylindrical boss 24 coaxially aligned with the first tip shank 19*a*, including a plurality of spaced annular discs 25 that are parallel relative to one another at spaced intervals to receive a cleaning swab thereabout in enhanced swabbing and cleaning of an associated firearm bore. The second tip member 20 includes a helical spring coil 26 mounted to the second tip shank 20*a* to a top surface thereof spaced from the associated bottom surface of the tip shank including the tip shank bore. A third shank boss 27 is defined by the third tip member 21, including a third shank boss loop 28, wherein the third shank boss 27 and the third shank boss loop 28 are coaxially aligned relative to one another as the loop 28 is arranged for receiving a cleaning patch therethrough. The fourth tip member includes a fourth tip member cylindrical head 29, including a semi-cylindrical dish 30 coaxially aligned at an upper end of the cylindrical head 29 to receive a bullet in a seating procedure within a muzzle of an associated muzzle loading firearm. The fifth tip member 23 includes a fifth tip member semi-cylindrical head 31 mounting a conical screw shank 32 thereto that may be directed into an associated bullet member to secure the bullet member to the fifth tip member to extract a stuck bullet relative to an associated bore of a rifle.

Figure 8:
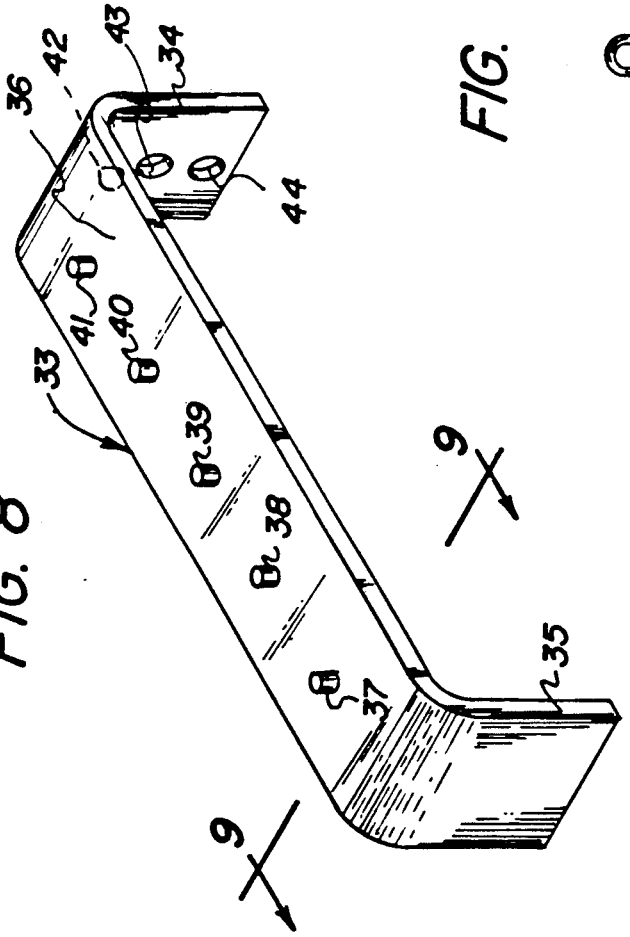
FIG. 8 is an isometric illustration of the holder structure utilized by the invention.
Figure 10:
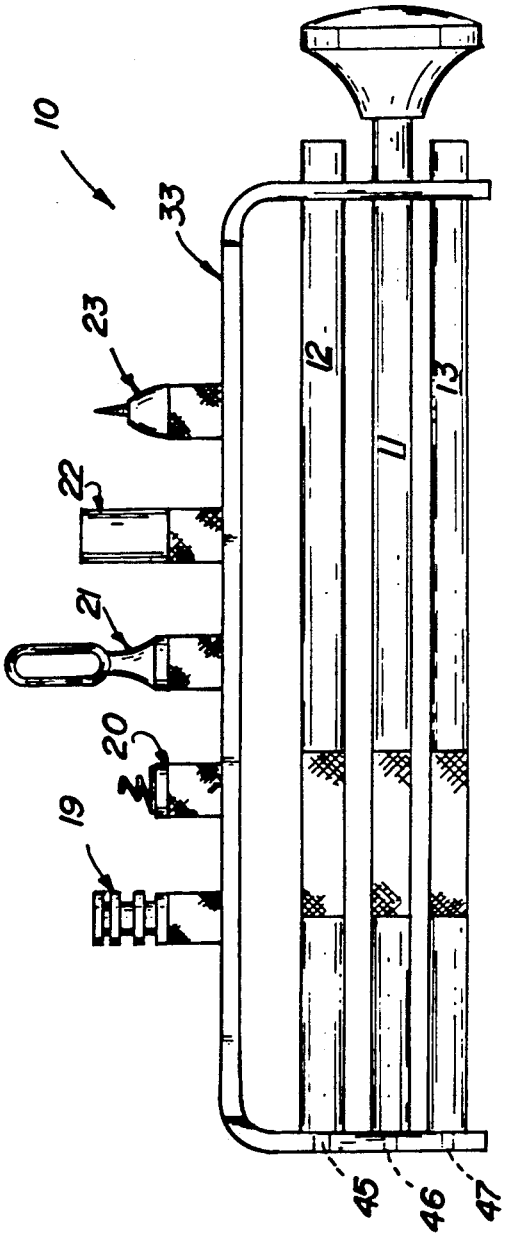
FIG. 10 is an orthographic side view of the kit in an assembled configuration.
Figure 11:
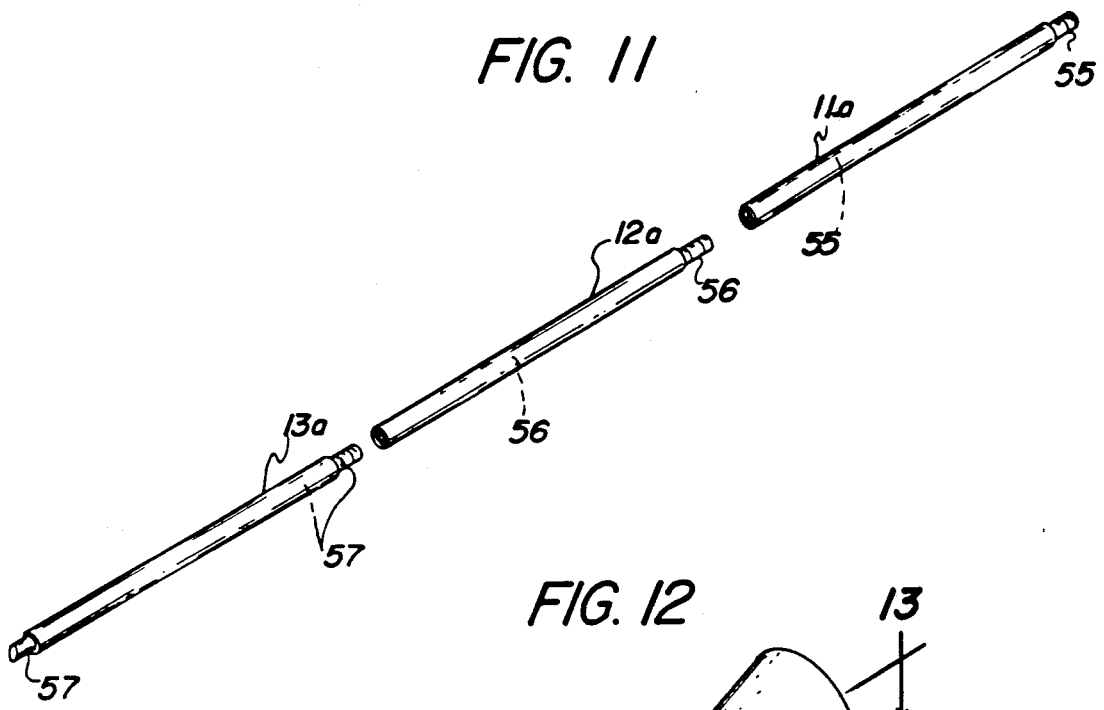
FIG. 11 is an isometric illustration of a modified rod structure utilized by the invention.
Figure 12:
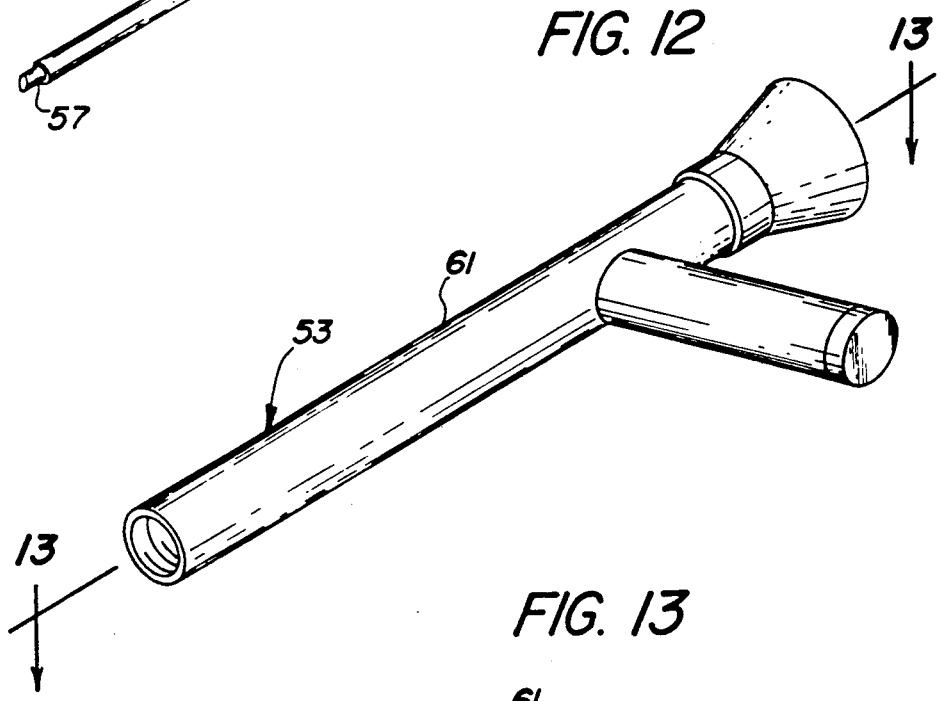
FIG. 12 is an isometric illustration of a viewing member utilized by the invention.
Figure 13:
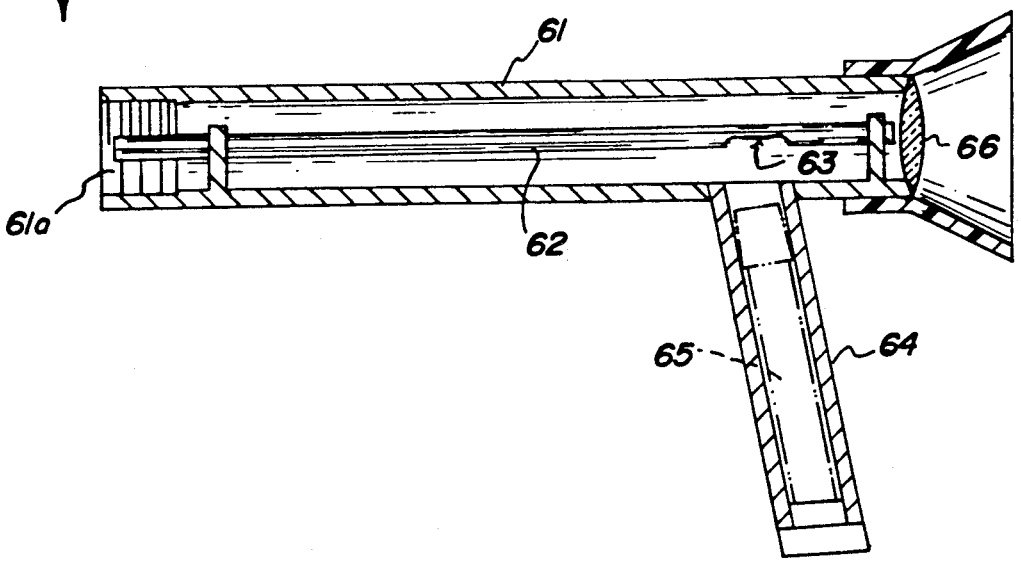
FIG. 13 is an orthographic view, taken along the lines 13—13 of FIG. 12 in the direction indicated by the arrows.

A "U" shaped holder 33 is illustrated in the FIG. 8, including a first leg plate 34 spaced from and parallel a second leg plate 35, with a holder central web 36 extending orthogonally to upper terminal edges of each of the first and second leg plates 34 and 35. The central web 36 includes a respective first, second, third, fourth, and fifth threaded boss 37, 38, 39, 40, and 41 respectively for threaded securement into each tip shank of the first through fifth tip members, as illustrated in FIG. 10. The first leg plate includes a first leg plate first, second, and third bore 42, 43, and 44 respectively whose axes are parallel relative to one another and orthogonally oriented relative to the second leg plate 35. In this manner, the second leg plate 35 includes respective first, second, and third second leg plate internally threaded bore 45, 46, and 47 respectively that are respectively coaxially aligned with the first, second, and third bores 42, 43, and 44. In this manner, each associated rod 11, 12, and 13 is slidingly received through the second, first, and third bores 43, 42, and 44 respectively and whose forward threaded tips or rods are received within the first, second, and third internally threaded bores 45, 46, and 47 to secure the rods to the leg plates. A third leg plate 48 is illustrated for use in the modified aspect of the invention 10*a* and is illustrated in FIG. 14, wherein the third leg plate 48 includes third leg plate first, second, and third bores 49, 50, and 51 coaxially aligned with the first, second, and third bores 42, 43, and 44 respectively to receive the extension rods therethrough. A leg plate fourth bore 51*a* is arranged for reception of a tubular housing 61 of a viewing member 53, and a support leg 52 mounted to the second leg plate 35 is threadedly secured to a forward distal end of the tubular housing 61 for securement of the tubular housing thereto. A modified primary rod 11*a*, a first extension rod 12*a*, and a second extension rod 13*a* each include respective first, second, and third fiber optic cable 55, 56 and 57 respectively directed therethrough in a coaxially aligned relationship that are arranged for contiguous end-to-end communication relative to one another to direct light continuously therethrough. The first fiber optic cable 55 includes an upper threaded tip threadedly received within the forward threaded bore 61*a* in a coaxial and contiguous alignment with a tubular housing fiber optic cable 62 coaxially aligned with the tubular housing for contiguous communication with the first fiber optic cable 55. The housing fiber optic cable 62 includes a recess 63 arranged in alignment with an illumination member 65 positioned within an illumination housing 64 directed obliquely relative to the tubular housing 61 to direct light into the fiber optic cable 62 and continuously through the first, second, and third fiber optic cables 55, 56, and 57, wherein a magnification lens 66 mounted at a rear distal end of the housing fiber optic cable 62 permits enhance viewing and illustration of various components within the associated bore of a firearm to permit visual inspection of condition of cleanliness and erosion within a firearm bore.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A muzzle loading firearm loading kit, comprising in combination, a "U" shaped holder, the "U" shaped holder including a first leg plate spaced from and parallel a second leg plate, and a central web, with the central web orthogonally and coextensively directed between the first leg plate and second leg plate and integrally mounted to the first leg plate and the second leg plate at opposed distal ends of the central web, and the first leg plate including a first leg plate first bore, a first leg plate second bore, and a first leg plate third bore, with the first bore, second bore, and third bore arranged in a coaxially spaced parallel relationship relative to one another, and the second leg plate including a second leg plate first internally threaded bore, a second leg plate second internally threaded bore, and a second leg plate third internally threaded bore, wherein the second leg plate first internally threaded bore is coaxially aligned with the first leg plate first bore, the second leg plate second bore is coaxially aligned with the second bore, and the second leg plate third bore is coaxially align with the first leg plate third bore, and a primary rod member, with the primary rod member including a primary rod member threaded boss, with the primary rod member slidably directed through the first leg plate second bore and the primary rod member threaded boss threadedly received within the second leg plate second bore, and a first extension rod, the first extension rod slidably received within the first leg plate first bore and the first extension rod including a first extension rod threaded boss, the first extension rod threaded boss threadedly received within the second leg plate first bore, and a second extension rod slidably directed and received through the first leg plate third bore and, the third extension rod including a third extension rod threaded boss threadedly received within the second leg plate third bore.

2. An apparatus as set forth in claim 1 wherein the central web includes a central web first threaded boss, a central web second threaded boss, a central web third threaded boss, a central web fourth threaded boss, and a central web fifth threaded boss, with each of the central web threaded bosses fixedly and orthogonally mounted relative to the central web, and a first tip member selectively and threadedly secured to the first threaded boss, a second tip member threadedly secured to the second threaded boss, a third tip member threadedly secured to the third threaded boss, a fourth tip member threadedly secured to the fourth threaded boss, and a fifth tip member threadedly secured to the fifth threaded boss.

3. An apparatus as set forth in claim 2 wherein the first tip member includes a first tip member cylindrical boss, and the cylindrical boss including spaced annular discs spaced therealong for receiving a cleaning patch thereabout, and the second tip member including a helical spring coil mounted coaxially to the second tip member projecting therefrom, and the third tip member including a third tip member loop for receiving a cleaning swab therethrough, and the fourth tip member including a cylindrical head, and the cylindrical head including a semi-cylindrical dish directed into the cylindrical head coaxially aligned therewith, and the fifth tip member including a conical screw shank projecting coaxially relative to the fifth tip member.

4. An apparatus as set forth in claim 3 including a third leg plate arranged parallel to and between the first leg plate and the second leg plate, and a third leg plate slidably receiving the primary rod member, the first extension rod, and the second extension rod therethrough, and the third leg plate including a third leg plate bore, and the second plate including a second leg plate lug, wherein the second leg plate lug is coaxially aligned with the third leg plate bore, and a view member is slidably received through the third leg plate bore and selectively securable to the second leg plate lug.

5. An apparatus as set forth in claim 4 wherein the view member includes a tubular housing, the tubular housing including a rear distal end and a forward distal end, and a fiber optic cable directed through and coaxially aligned within the tubular housing, and a magnification lens mounted to the rear distal end of the tubular housing at a rear distal end of the fiber optic cable, and an illumination housing secured to the tubular housing defining an oblique angle between the illumination housing and the tubular housing, and the illumination housing including an illumination member contained therewithin, and the fiber optic cable including a fiber optic cable recess in confrontation with and in alignment with the illumination member to project illumination into the housing fiber optic cable through the fiber optic recess.

6. An apparatus as set forth in claim 5 wherein the primary rod includes a first fiber optic cable directed therethrough, the first extension rod includes a second fiber optic cable directed therethrough, and the third extension rod includes a third fiber optic cable directed therethrough, wherein the first fiber optic cable, the second fiber optic cable, the third fiber cable, and the housing fiber optic cable are arranged for contiguous coaxially aligned communication relative to one another to direct illumination from the housing fiber optic cable into the third fiber optic cable.

* * * * *